US006394669B1

(12) United States Patent
Janosky et al.

(10) Patent No.: US 6,394,669 B1
(45) Date of Patent: May 28, 2002

(54) POST-PRINT TREATMENT PROCESSOR FOR A PHOTOFINISHING APPARATUS

(75) Inventors: Mark S. Janosky; James A. Larrabee, both of Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/684,183

(22) Filed: Oct. 6, 2000

(51) Int. Cl.[7] ..... G03D 15/06; G03D 5/00; G03D 17/00

(52) U.S. Cl. ..... 396/571; 396/580; 396/585; 396/604; 396/599

(58) Field of Search ..... 396/599, 604–606, 396/626, 627, 580, 571, 585; 355/27–29; 83/15, 79, 71, 368; 347/101

(56) References Cited

U.S. PATENT DOCUMENTS

| | | | | | |
|---|---|---|---|---|---|
| 3,831,478 | A | * | 8/1974 | Wright et al. | 83/368 |
| 4,506,824 | A | * | 3/1985 | Bartz | 83/71 |
| 4,785,313 | A | | 11/1988 | Higuma et al. | 347/105 |
| 4,832,984 | A | | 5/1989 | Hasegawa et al. | 427/161 |
| 5,555,011 | A | * | 9/1996 | Tang et al. | 347/212 |
| 5,760,917 | A | * | 6/1998 | Sheridan | 358/442 |
| 5,847,809 | A | * | 12/1998 | Matsutani | 355/27 |
| 5,984,539 | A | * | 11/1999 | Patton et al. | 396/604 |
| 6,087,051 | A | * | 7/2000 | Shiji et al. | 430/14 |
| 6,109,745 | A | * | 8/2000 | Wen | 347/101 |
| 6,168,259 | B1 | * | 1/2001 | Capurso | 347/36 |
| 6,206,586 | B1 | * | 3/2001 | Wen et al. | 396/604 |
| 6,213,656 | B1 | * | 4/2001 | Piccinino, Jr. et al. | 396/599 |
| 6,217,167 | B1 | * | 4/2001 | Wen et al. | 347/101 |

FOREIGN PATENT DOCUMENTS

| | | |
|---|---|---|
| EP | 0 702 497 A1 | 9/1995 |
| EP | 0 858 905 A1 | 2/1998 |
| EP | 0 858 906 A1 | 2/1998 |
| EP | 0 992 347 A2 | 9/1999 |

* cited by examiner

*Primary Examiner*—D Rutledge
(74) *Attorney, Agent, or Firm*—David A. Novais

(57) ABSTRACT

A photofinishing apparatus is designed such that full bleed durable prints are produced with a high productivity and low waste generation process. The photofinishing apparatus in this case includes a printer and a finisher or post-print treatment processor. The printer is designed to produce media segment with multiple images of various formats. This media segment is then transported to the post-print treatment processor. The post-print treatment processor includes a dryer station, a durability station, a two-axis cutting station, and a print sorting station. The dryer performs the function of drying the media segment. The durability station performs the function of applying and or fixing durability material on the media segments. The two-axis cutting station includes slitting and chopping stations that performs the required two-axis cutting that produces the full bleed prints. Finally, the print sorting station performs the sorting of the prints such that the full bleed durable prints can be returned to customers.

21 Claims, 5 Drawing Sheets

135 LAYOUT (8"x24")

135 LAYOUT (8"x12")

MIXED APS LAYOUT (8"x24")

MIXED APS LAYOUT (8"x24")

MIXED APS LAYOUT (8"x18")

MIXED APS LAYOUT (8"x12")

8"x10"LAYOUT

5"x7"LAYOUT

POST-PRINT TREATMENT PROCESSOR FOR A PHOTOFINISHING APPARATUS

FIELD OF THE INVENTION

The present invention relates to a photofinishing apparatus for reproducing images, more particularly to a compact image reproducing apparatus that prints images, applies or fixes the images with a durable material and delivers those images in a finished full bleed cut print state with a minimization of media waste production.

BACKGROUND OF THE INVENTION

Durability is a performance criterion that is expected by consumers of photographic prints. This criterion includes resistance to tearing, fading, water and chemical exposure plus numerous other factors. In the current state of the art, silver halide prints demonstrate a high degree of overall durability in relation to other printing methods such as ink jet and thermal dye diffusion. This fact is one of the reasons why other forms of photographic quality printing technologies are not completely supplanting the silver halide share of the market. However, these other technologies are rapidly improving durability through the addition of materials and processes.

One example of a non-silver halide printing process that produces a durable photographic quality print is the Kodak Picture Maker. The Kodak Picture Maker creates durable prints by using the same thermal dye diffusion printing process that is used to produce the image on the media. Specifically, this printing process is one in which dye is transferred from a donor ribbon to media by means of heating a thermal printhead while the printhead, donor ribbon and media are in mechanical contact. By performing this process in a serial fashion for three separate primary color patches (sometimes there is a fourth black patch) in a controlled manner, an image can be produced on the media. To ensure durability, this printing process is performed one more time except that instead of dye transfer, a continuous clear overcoat material is transferred to the media. This process is often referred to as peel-apart or thermal transfer overcoat (TTO).

A second example of a non-silver halide printing process that produces a durable photographic quality print is the Canon Hyperphoto. Patents associated with this type of process are U.S. Pat. Nos. 4,832,984 and 4,785,313, as well as European Patents 0 858 905 A1 and 0 858 906 A1. In the Canon Hyperphoto case the original media has already been pre-coated with a special chemical layer prior to printing (actually done during the production of the media). This coating is designed such that during the ink jet printing process, the inks can penetrate the layer and stabilize on an ink-receiving layer below the special coating. The Canon Hyperphoto then uses a heated fuser to seal this top coating over the image after the print cycle is complete. This process is often referred to as incorporated since the durability material is already incorporated into the media prior to printing.

Both of these apparatuses produce prints that are quite acceptable to consumers both from an image quality and durability aspect. However, there still are issues to consider. For example, these technologies are slower at producing prints per unit of time (defined as productivity) than a comparable machine associated with silver halide technology. This is partly due to the fact that these printing processes are slower than silver halide printers, but in addition the need to apply a durable material involves another process which adds more time. Another issue is that these printing processes do not inherently produce full bleed prints, which is a standard within the photofinishing retail business. In fact, the prints produced by the two aforementioned printing systems have borders and require an additional manual or automated cutting process to produce full bleed finished prints. This course of action only exasperates the already low productivity just described. Therefore, there is a need to print with high productivity, still allow a durable material to be fixed or applied, and efficiently produce full bleed finished prints for printing systems such as ink jet and thermal dye diffusion to compete in the photofinishing market.

The solution to this need can utilize various strategic paths. One path that is being taken by numerous printer companies is to attack the need by increasing the speed of the base printing mechanism. For example, in the ink jet printing industry, there is an effort to increase the firing rate of print heads as well as the number of actuators or nozzles per print head in order to achieve higher speed addressing of media space. While this strategy makes sense, it does not preclude other less direct solution paths. For example, Capurso describes in European Patent 0 992 347 A2 a reservoir for collecting the excess ink that is sprayed outside of the media within an ink jet printer. This mechanism would thus allow full bleed prints to be more easily produced within a given printer architecture. One illustration of this would be to have a classic desktop ink jet printer working with a fixed width continuous roll of media. The printer could continually print out full bleed images that with a single chopper-cutting machine could easily turn these images into individual full bleed prints. The problem with this scenario is that this machine does not have the productivity that is anywhere close to what is expected in photofinishing sites. One could multiplex many of these machines but issues will exist in the areas of footprint, printer variation, durability application, and sorting.

Another form of indirect solution is to efficiently architecture all of the processes that take printed media and convert it into the finished full-bleed prints. These processes include the printing itself but also could include the durability fixing or application, drying, cutting and sorting. We define here that the processes other than the printing itself are post-print treatment processes. If these processes are architectured efficiently around the printing, then one should able to minimize the issues discussed throughout this section. For example, European Patent 0 703 497 A1 to B. A. Phillips et al offers an example of a cutting system that produces finished full-bleed prints. One basic drawback of European Patent 0 703 497 A1 is that the design is narrowed to a media segment with a fixed size plurality of images printed on the media segment. This is an issue in a system that must handle variable formats such as now exists with the advent of the Advanced Photo System (APS). The second drawback is that this system describes that it can do this cutting without producing any waste media byproduct. However, this assumption would be based on very precise image placement on the media segment and very precise cutting mechanisms. A third issue is that in a printing system that also requires a fixing or application of a durability material, the modular design of the cutter requires some interface to the durability mechanism. This interface is critical at meeting productivity and footprint criteria. Therefore, the intention of the invention is to describe a post print treatment system of a general architecture that minimizes most of the issues just stated. More specifically, the present invention relates to a photofinishing apparatus for reproducing images, more particularly to a compact image reproducing apparatus that prints images, applies or fixes the images with a durable material and delivers those images in a finished full bleed cut state with a minimization of media waste production.

SUMMARY OF THE INVENTION

An object of the present invention is to produce photographic quality durable full bleed images. By full bleed images, Applicant's are referring to image or prints with no border or images that extend to the end of a print.

A further object of the invention to produce durable printed images with minimal waste of the media and durability materials.

A further object of the invention to minimize the time required in producing a customer order that comprises a plurality of the durable full bleed prints.

A further object of the invention is to complete multiple pending customer orders in minimum time.

In accordance with one aspect of the present invention, there is provided an apparatus for printing a plurality of images on media provided on a supply roll, with the media having a predetermined width. The apparatus comprises a printer that produces a media segment of variable length with a plurality of printed images.

In accordance with a further aspect of the present invention, there is provided an apparatus for performing any post-print treatment functions resulting in the production of the full bleed durable prints. The apparatus comprises a drying station that removes a desired amount of water from the media segment; a durability station that performs all of the operations needed to apply or fix the durability material on the media segment; a cutting station that performs all of the operations required to cut the media segment into the full bleed durable prints; a sorting station that takes the full bleed durable prints and puts them into an arrangement which makes it easy for the full bleed durable prints to be returned to a customer; and a control computer and control electronics that performs all of the machine control for the drying, durability, cutting and sorting stations.

In accordance with a further feature of the invention the post-print treatment apparatus performs the processes in a manner that optimizes productivity while minimizing waste production.

The present invention therefore relates to a photofinishing apparatus which comprises a processing assembly for processing a plurality of images and producing a media segment having the images thereon; and a post-print treatment assembly provided in series with the processing assembly and adapted to at least apply a durable material onto the media segment.

The present invention further relates to a method of photofinishing which comprises the steps of processing a plurality of images and producing a media segment having the images thereon; and applying a durable material on the media segment.

The present invention further relates to a photofinishing apparatus which comprises: a film processor for processing rolls of film into negatives; a scanner for digitizing the negatives or other printed images into raw image data; an image data manager for processing the raw image data into processed image data; a printer for converting the processed image data into printed images on a media segment; and a post-print treatment processor for converting the media segment into photographic quality durable full bleed prints. The post-print treatment processor includes a dryer station for drying the media segment; a durability station for applying or fixing a durability material on the media segment; a cutting station for slitting and chopping the media segment into the photographic quality full bleed prints; a sorting station for sorting the photographic quality full bleed prints; and a control computer and control electronics for controlling the post-print treatment processor.

The present invention further relates to a photofinishing method which comprises the steps of scanning images to create image data representative of the scanned images; processing the image data to create processed image data; printing the processed image data to create printed images on a media segment; drying the media segment; applying or fixing a durability material on the media segment; slitting and chopping the media segment into photographic quality full bleed prints; and sorting the photographic quality full bleed prints The present invention further relates to a post-print treatment processor for converting a media segment into photographic quality durable full bleed prints, which includes: a dryer station for drying the media segment; a durability station for applying or fixing a durability material on the media segment; a cutting station for slitting and chopping the media segment into the photographic quality full bleed prints; a sorting station for sorting the photographic quality full bleed prints; and a control computer and control electronics for controlling the post-print treatment processor.

The present invention further relates to a photofinishing apparatus which comprises a printing station for printing images on a media segment; and a finishing station for converting the media segment into durable full-bleed prints. The finishing station includes a durability station for applying or fixing a durability material on the media segment; and a cutting station for slitting and chopping the media segment into the photographic quality full bleed prints.

The present invention further relates to a photofinishing apparatus which comprises a processing assembly for processing images and producing a media segment having at least one image thereon; and a post-print treatment assembly provided in series with the processing assembly and adapted to at least apply a durable material onto the media segment and cut the media segment to produce a finished full bleed cut print.

The above and other objects, advantages and novel features of the present invention will become more apparent from the accompanying detailed description thereof when considered in conjunction with the following drawings.

BRIEF DESCRIPTION OF THE DRAWINGS

In the detailed description of the preferred embodiments of the invention presented below, reference is made to the accompanying drawings in which.

DETAILED DESCRIPTION OF THE INVENTION

The present description will be directed in particular to elements forming part of, or in cooperation more directly with, the apparatus in accordance with the present invention. It is understood that elements not specifically shown or described may take various forms well known to those skilled in the art.

Figure 1:
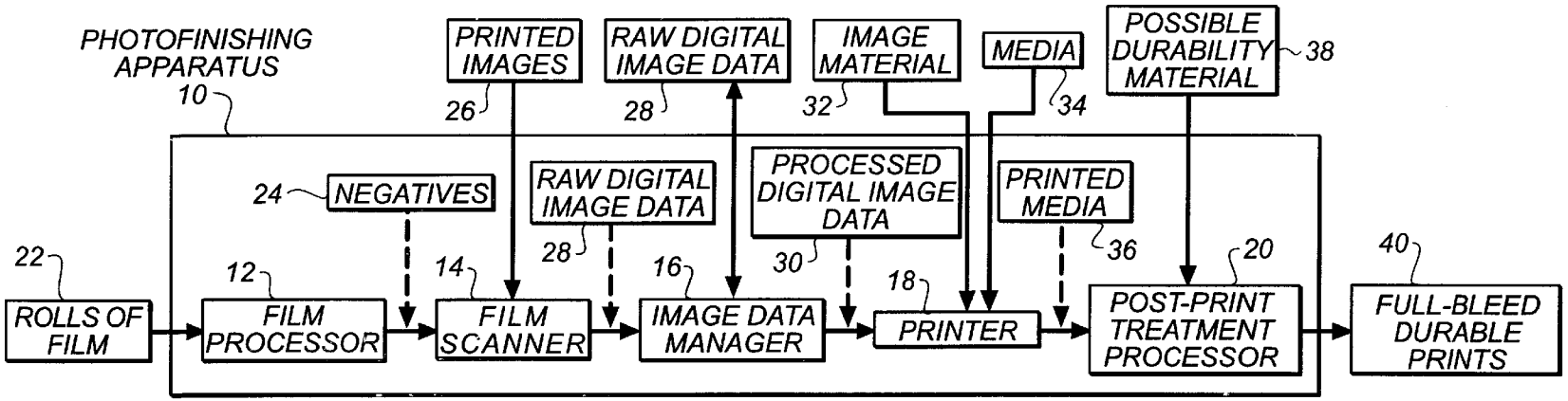
FIG. 1 is a photofinishing apparatus block diagram.

Referring now to the drawings, wherein like reference numerals represent similar or corresponding parts throughout the several views. FIG. 1 illustrates a block diagram of a generic photofinishing apparatus 10. Photofinishing apparatus 10 is partitioned into five major subsystems. These subsystems include a film processor 12, a film scanner 14, an image data manager 16, a printer 18, and a finisher or post-print treatment processor 20. The basic functions of each of these systems are described as follows. Film processor 12 chemically processes rolls of film 22 (orders) into negatives 24. Scanner 14 digitizes negatives 24 or other printed images 26 into raw digital image data 28. Image data manager 16 performs image processing on raw digital image data 28 (either from an outside source or from film scanner 14) and converts this raw digital image data 28 into processed digital image data 30. Printer 18 then uses this processed digital image data 30, image materials 32 (such as ink in an ink jet printer) and media 34 to produce printed media 36. Finally, finisher or post-print treatment processor 20 performs any operation following printing such as back printing (back printing may be part of printer 18) drying, durability application or fixing, cutting, and/or print sorting which results in full bleed durable prints 40. The durability application function within post-print treatment processor 20 will apply or fix a durability material 38.

Two of the requirements for photofinishing apparatus 10 are to have the ability to produce full bleed durable prints 40 rapidly (often referred to as productivity or throughput) and minimize waste generation in the materials that are used, such as waste created when cutting off borders from the images. To maximize these needs, photofinishing apparatus 10 should have a solid architecture between the five major subsystems just described. A feature of this invention relates to the architecture that exists between printer 18 and post-print treatment processor 20. This architecture area should be an area of focus since these two subsystems (printer 18 and post-print treatment processor 20) perform mechanical processes that affect productivity and material use and waste.

Starting with printer 18, there are numerous technologies that can be used to produce photo quality prints. The preferred embodiment here is ink jet but could just as easily be thermal dye sublimation or even digital silver halide. Meeting the productivity and minimal waste requirements in any of these printing technologies is a function of how fast the printing technology can address an area of media and complete the high quality printing event. In the case of ink jet this productivity rate is affected by numerous parameters associated with the print head, transport mechanism and amount of area to be addressed in a single printing operation. However, this may not be an issue so long as the printer 18 can produce printed media 36 at a rate that is conducive to meeting the requirements for photofinishing apparatus 10.

Figure 2:
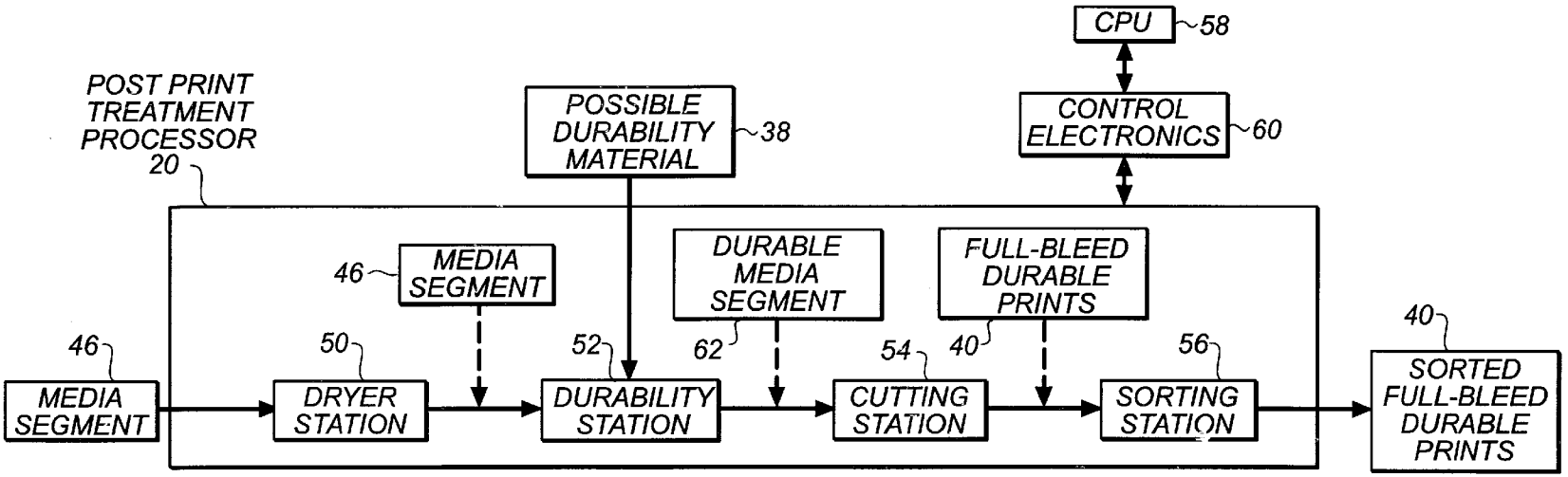
FIG. 2 is a post-print treatment processor block diagram.
Figure 3A:
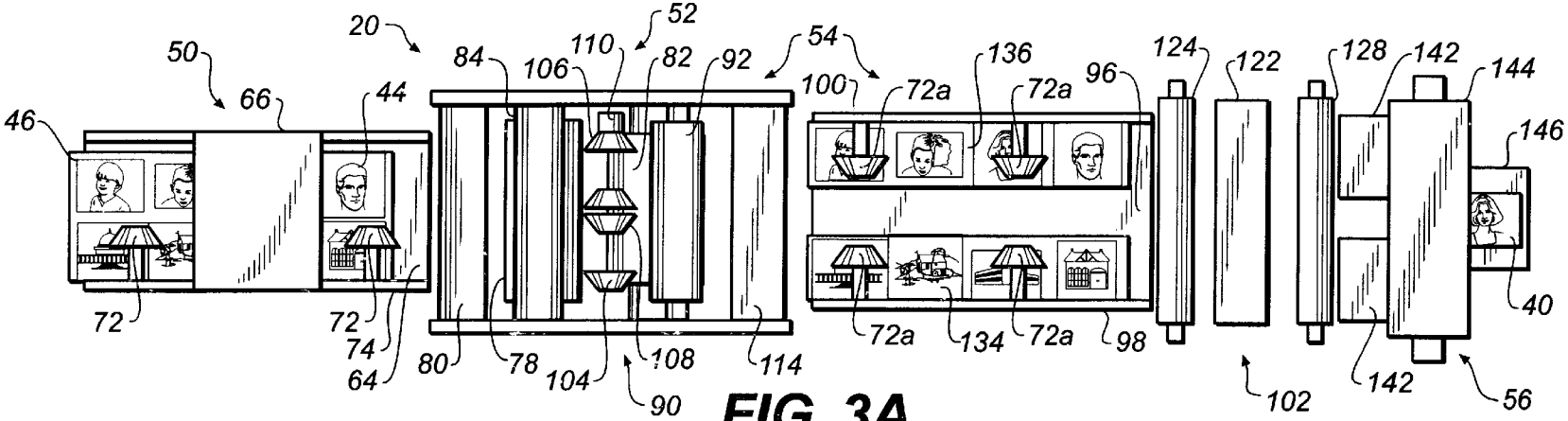
FIGS. 3A–3B show a top view of a preferred embodiment of the apparatus of the invention.

A feature of this design is that printed media 36 from printer 18 must goes through numerous other processes in finisher or post-print treatment processor 20 while maintaining the high productivity needs. A relevant matter here is the format of printed media 36 as it leaves printer 18. There are three basic formats that can be used. The first format is printed media 36 that is already cut into full bleed prints 40. The second format is printed media 36 that have a plurality of images on a media segment 46 (FIGS. 2 and 3A). The third and final format is printed media 36 that is continues or in a roll form. While each format demonstrates some tremendous advantages, this particular invention will focus on the media segment 46 format which includes multiple images on a print, as well as borders along the edges and between the images. The basic reasons for this choice evolve from the fact that the preferred durability technology for this embodiment is lamination. The choice of lamination basically eliminates full bleed print 40 since two-axis cutting will still be required in post-print treatment processor 20 and this is the main advantage of full bleed prints 40. The roll feed system is eliminated if one considers that photofinishing apparatus 10 being discussed in this invention is of the type used in a Microlab market segment. Microlabs are expected to be able to handle single orders (print on demand) from customers and a system that uses a roll format throughout is more conducive to a batch type of Minilab operation.

Therefore, with the choice of format being media segment 46, we now can discuss the specifics of the architecture that is used for post-print treatment processor 20. FIG. 2 illustrates a block diagram of the preferred embodiment of post-print treatment processor 20. Post-print treatment processor 20 is partitioned into four major process stations. These process stations include a drying station 50, a durability station 52, a cutting station 54, and a sorting station 56. The machine control of these stations is performed by a control computer (CPU) 58 and control electronics 60. The basic functions of each of these stations are described as follows.

Drying station 50 performs any necessary drying prior to any durability application or fixing that will take place. Durability station 52 performs the function of either applying a durability material 38 to media segment 46 or fixing (such as fusing) a pre-coated durability material 38 on media segment 46 to produce a durable media segment 62. Examples of durability materials 38 that need to be applied are the peel-apart overcoats, a conventional laminates (both one-sided and two-sided), and liquid overcoats. Examples of durable materials that need to be pre-coated are the Canon material found in European Patent 0 858 905 A1. Cutting station 54 performs the function of converting durable printed media 62 into full bleed durable prints 40. Finally, sorting station 56 performs the function of taking full bleed durable prints 40 from cutting station 54 and organizing them in a way that the photofinisher can return the full bleed durable prints 40 to a customer as sorted full bleed durable prints 40'.

Figure 4:
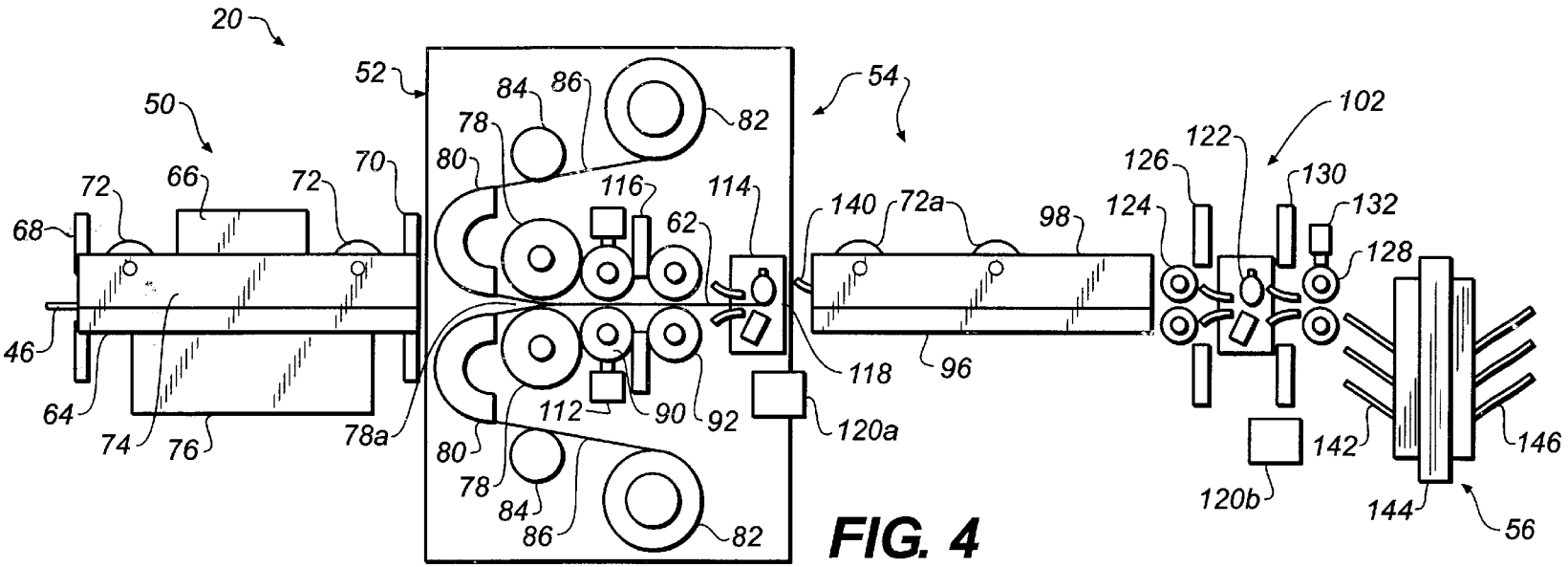
FIG. 4 shows a side view of the preferred embodiment of the apparatus of the invention.
Figure 3B:
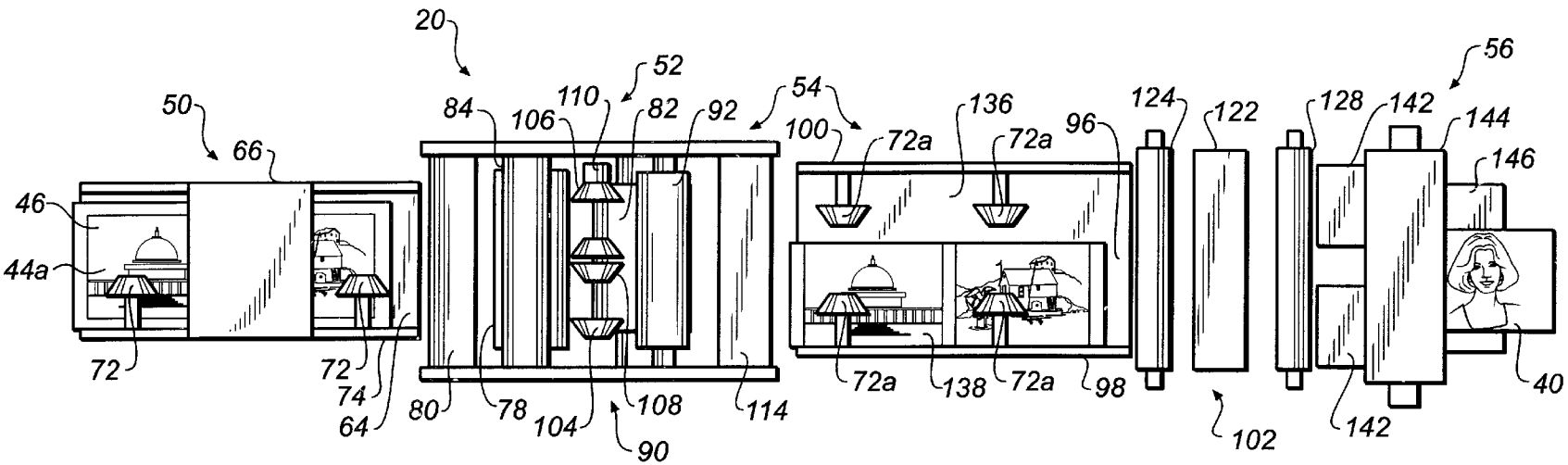
Figure 5A:
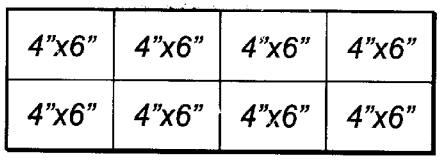
FIGS. 5A–5H illustrate a sample case of the type of image tiling that can occur on a media segment sheet.
Figure 5B:
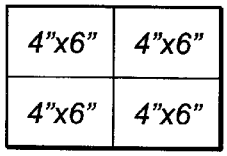
Figure 5C:
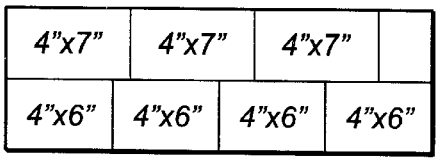
Figure 5D:
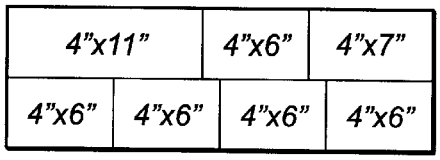
Figure 5E:
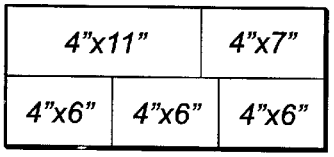
Figure 5F:
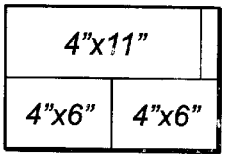
Figure 5G:
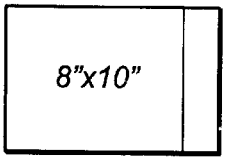
Figure 5H:
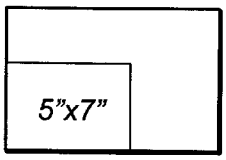

The process thread that holds these stations together is the basic media transport that occurs throughout post-print treatment processor 20. This transport encompasses a further feature of the invention. FIGS. 3A, 3B and 4 illustrate the detailed architecture of a preferred embodiment of post-print treatment processor 20 that pertains to this invention. These figures illustrate the top and side view perspectives, and can be referenced along with FIG. 2 for the rest of the description. The following details how media segments 46 are transported through post-print treatment processor stations 50, 52, 54 and 56 and converted into sorted full bleed durable prints 40.

We begin by describing the preferred embodiment of media segment 46. As noted, printer 18 can use any preferred printing technology but should be able to produce a media segment 46 that has a plurality of printed images 44 (FIG. 3A) or a single image 44*a* (FIG. 3B). With respect to FIG. 3A, the plurality of images 44 may be tiled or positioned on media segment 46 in numerous combination forms with borders between the images and/or along the edges of the images. These combinations are mainly a function of the geometry of media segment 46, the print formats that can be worked with by the overall photofinishing apparatus 10, and the statistical image makeup of film or digital orders being processed by photofinishing apparatus 10. For example, FIGS. 5A–5H illustrates a number of potential cases of how an assortment of image formats can be tiled onto media segment 46. Specifically, 135 (4"×6") (FIGS. 5A, 5B), Advanced Photo System (APS) (including 4"×6" Classic, 4"×7" HDTV and 4"×11" Panoramic) (FIGS. 5C–5F) and other print size formats (for example, 5"×7" and 8"×12") (FIGS. 5G–5H) are the formats illustrated here. Media segments 46 in these preferred cases have variable lengths ranging from 12+ to 24+ inches, while the width is 8+ inches. Note how the 135 size images are placed in a two-up across arrangement on all configurations except those requiring print formats larger than 135. Also note that the plus sign on the geometric dimensions accounts for the fact that media segments 46 must have extra media area that will be cut out in downstream cutting operations.

With the description of media segment 46 complete, we now describe how these media segments 46 are processed through stations 50, 52, 54 and 56 of post-print treatment processor 20. The overall process begins with the transfer of media segment 46 from printer 18 to drying station 50. As shown in FIGS. 3A, 3B and 4, drying station 50 includes a front platen 64, a dryer 66, an entrance detection sensor 68, an exit detection sensor 70, a set of urge rollers 72, a front platen edge guide 74 and a front platen alignment mechanism 76. Drying station 50 receives media segment 46 as follows. The lead edge of a media segment 46 feeds onto front platen 64 from printer 18 and entrance detection sensor 68 detects it. This detection allows control computer 58 to begin the control of the drying and transport functions through control electronics 60. First, dryer 66 is set to an appropriate temperature. Next, urge rollers 72 that are used to transport media segment 46 through drying station 50 are sped up to the appropriate speed. This speed is set so as to allow the desired amount of drying to take place as media segment 46 passes under dryer 66 and moves toward durability station 52. Two notes need to be made at this point. First, urge rollers 72 are spaced at a distance that is conducive to handling the minimum length of media segment 46 that will be handled by post-print treatment processor 20. Second, dryer 66 uses infrared radiation technology in this embodiment but could also use forced air convection, conduction or other means.

Next, the same urge rollers 72 that provide the basic forward motion transport are used in combination with front platen edge guide 74 and front platen alignment mechanism 76 to perform an alignment function for upstream cutting station 54. Basically, urge rollers 72 use conical shaped rollers that provide forward and lateral motion simultaneously. By designing the frictions and loads between urge rollers 72, media segment 46 and front platen 64 correctly, media segment 46 will straighten out and ride with one side edge against front platen edge guide 74. At this point, the alignment now is dependent on the alignment of front platen 64 and durability station 52. This is accomplished by using front platen alignment mechanism 76 that is adapted to allow all or some of the six rigid body degrees-of-freedom of front platen 64 to be adjusted.

Figure 7:
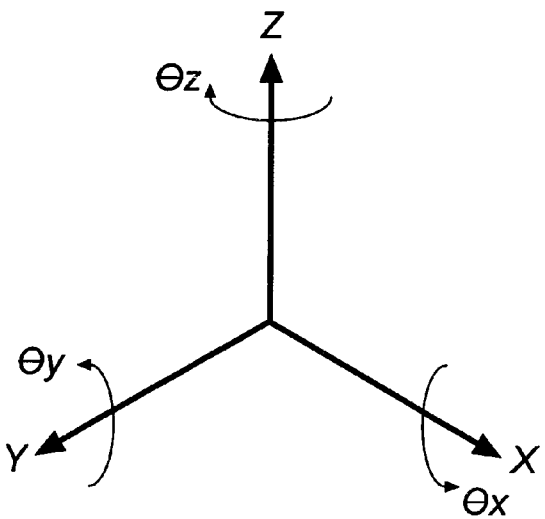
FIG. 7 illustrates a basic coordinate directional graph.

In a generic form, the front platen alignment mechanism 76 requires five of the six rigid body degrees-of-freedom to be adjusted. FIG. 7 illustrates the basic coordinate direction associated with the relationship between the front platen 64 and the durability station 52. It is noted that in FIG. 7, X is the direction along which the media moves. In understanding which directions require alignment, let us start with the linear coordinates, X, Y, and Z. Along the X direction, the distance between the trail edge of the front platen 64 and the entrance nip 78*a* created by the fuser roller set 78 (FIG. 4) needs to be established. This distance should be set accurately to allow the media segment 46 to enter the nip smoothly so that the segment is not driven in an undesired direction. Along the Y direction, the front platen edge guide 74 should be set so the edge of the media is aligned for downstream cutting. Along the Z direction, the relative height between the trail edge of the front platen 64 and the height of the entrance nip 78*a* needs to be established for the same reason discussed for the X direction. We now can examine the rotational axes, θx, θy, and θz. θx is considered for the same reason as the X and Z directions. θy is not critical as long as the X and Z direction alignments are made. θz is considered for the same reason as the Y direction. There are many alignment mechanisms that can be combined to allow these adjustments to be made. For example, simple slotted plates in conjunction with micrometers pushing on dowels running through the slots can adjust the location of the plates. Once alignment is achieved normal fasteners can be used to lock down the plates to the aligned orientation.

In the preferred embodiment discussed here, this alignment is beneficial since the accuracy of cutting station 54 upstream is dependent on getting media segment 46 to go through laminator durability station 52 along a defined path. In other durability cases such as TTO or incorporated, this is not as critical but media segment 46 still requires some alignment to prevent paper jams and other media transport failure modes.

At this point, media segment 46 is approaching the entrance of durability station 52. In this embodiment durability station 52 is a two-sided laminator which includes a fuser roller set 78, a heating shoe set 80, a laminate supply roll set 82, an idler bar set 84 and two strands of laminate 86 that are threaded throughout these elements. The entrance to laminator durability station 52 is basically a nip 78*a* created by fuser rollers 78. Just prior to entering this nip, media segment 46 will trigger exit detection sensor 70 within drying station 50. The signal generated by exit detection sensor 70 will be used by control computer 58 and control electronics 60 to start the lamination process.

Up to this point in time, laminator durability station 52 has been placed in an idle mode. This idle mode is one where laminate 86 is not being transported but heating shoes 80 and fuser rollers 78 are actively warming the strands of laminate 86 to a ready state. The purpose of using this idle condition is to minimize waste. We would not want to be running laminate 86 through laminator durability station 52 without the presence of media segment 46. Therefore, exit detection sensor 70 is strategically located the minimal distance from nip 78*a* such that fuser rollers 78 can be accelerated to a speed equal or above the speed at which media segment 46 is entering nip 78*a*. This allows smooth, accurately aligned lamination to occur.

After lamination, media segment 46 is now sandwiched on both sides by laminate 86 resulting in a laminated media segment 62. This laminated media segment 62 is now ready to go through a two-axis cutting process within cutting station 54. Cutting station 54 is comprised of a slitting station 90, a pull roller set 92, a segment chopping station 114, a rear platen 96 (including urge rollers 72*a*), a rear platen right edge guide 98, a rear platen left edge guide 100, and a print chopping station 102. Slitting station 90 is further broken down into a right edge slitter 104, a left edge slitter 106, a center slitter 108, an edge slitter position mechanism 110 and a center slitter retract mechanism 112. Segment chopping station 114 is further broken down into a segment chopper 114*a*, a segment detection sensor 116, a waste control mechanism 118, and a waste drawer 120*a*. Print chopping station 102 is further broken down into a print chopper 122, a lead edge metering roller set 124, a lead edge sensor 126, a trail edge metering roller set 128, a trail edge sensor 130, a metering roller retract mechanism 132 and another waste drawer 120*b*.

The basic processing of the laminated media segment 62 through cutting station 54 begins by looking at the pre-threading of laminate 86. Basically, laminate 86 from the two laminate supply rolls 82 are pre-threaded around idler bars 84, around heating shoes 80, through fuser rollers 78, through slitting station 90, through pull rollers 92 and finally out of segment chopper 114. This threading is done for a multitude of reasons. First, it is done because the transport of laminated media segment through laminator durability station 52 comes from pull rollers 90 in cutting station 54. While it is true that fuser rollers 78 also can act as transport rollers, the fact is that pull rollers 90 are run at a slightly higher speed than fuser rollers 78. This speed difference creates tension in the web between the pull rollers 90 and the fuser rollers 78. This, in turn, produces two advantages. First, it allows basic wrinkles and general discontinuities of the two laminates 86 to be minimized. Second, it provides a means to aid slitter station 90 in performing more accurate and cleaner slitting.

As laminated media segment 62 is pulled through slitting station 90, two slitting modes can be utilized as a result of the need to handle the tiling formats illustrated in FIGS. 5A–5H. The first mode involves the slitting of the two-up across tiling arrangements. In this mode, right edge slitter 104, left edge slitter 106, and center slitter 108 are engaged. As pull rollers 92 pull laminated media segment 62 through the slitting station 90, laminated media segment 62 is actually split into two new media segments, a right split laminated media segment 134 and a left split laminated media segment 136 (FIG. 3A). The waste material generated by the slitting operation is deposited into waste drawer 120*a*.

In addition to this edge and center waste, another issue must be resolved. This issue is the waste associated with the leader of laminate 86 that exists ahead of original media segment 46. This leader is simply a product of the laminate 86 pre-threading need. The length of this leader is approximately the distance between fuser rollers 78 and segment chopper 114. As media segment 46 enters nip 78*a* of fuser rollers 78 during the lamination process, this leader is exiting segment chopper 114. The problems with this leader are the facts that it is waste and it is typically not as stiff as the overall laminated media segment 62. The waste issue can be dealt with by minimizing the distance between fuser rollers 78 and segment chopper 114. The stiffness issue presents a problem in the basic transport of right split laminated media segment 134 and left split laminated media segment 136 as they are fed onto rear platen 96. This issue is dealt with by waste control mechanism 118.

There are many ways to design waste control mechanism 118 but the embodiment described here simply relies on gravity and geometric alignment. Basically, waste control mechanism 118 is a geometric gap between segment chopper 114 and rear platen 96. Therefore, as the leader of laminate 86 comes out of segment chopper 114 it simply is allowed to go where it wants in a free state only constrained by the nip created by pull rollers 92. This leader continues on until the lead edge of the media portion of the laminated media segments 62 goes through pull rollers 92. The segment detection sensor 116 detects this lead edge. The signal from segment detection sensor 116 causes segment chopper 114 to be activated at a point where a majority of the leader of laminate is cut off and through gravity falls into waste drawer 120*a*. Note that all of these events occur while the laminated media segment 62 is in motion. Therefore, the cut is not precise. This is fine as the intent of the cut is to simply allow the new lead edge to be in a stiff enough condition to allow downstream web handling to be done with more ease.

With this additional stiffness, it is easier for pull rollers 92 to push right split laminated media segment 134 and left split laminated media segment 136 between the respected sets of urge rollers 72a and rear platen 96. A set of spring fingers 140 aids this guidance action. This pushing action continues until segment detection sensor 116 detects the media segment trail edge of the right split laminated media segment 134 and left split laminated media segment 136. The signal from this detection is used by the intelligence of control computer 58 and control electronics 60 to drive right split laminated media segment 134 and left split laminated media segment 136 until their trail edge is just slightly downstream of segment chopper 114.

At this point, the entire transport system of post-print treatment processor 20 is shutdown and laminator durability station 52 is put into an idle mode again. As the right split laminated media segment 134 and left split laminated media segment 136 rest on rear platen 96, segment chopper 114 is activated and a single cut is made. The two split media segments are now completely independent of laminate strands 86 and one another. We note that laminator durability station 52 remains threaded with laminate 86 for the next media segment 46 that will be processed.

Once the right split laminated media segment 134 and left split laminated media segment 136 (FIG. 3A) are separated from one another, they need to be aligned for the final print chopping process. This alignment process begins by allowing urge rollers 72*a* associated with right split laminate media segment 134 to drive the segment toward print chopping station 102. The alignment occurs in the exact same manner as was described for front platen 64. Beginning with the right side, urge rollers 72*a* use their conical shape to laterally move the right split laminated media segment toward the rear platen right edge guide 98 while simultaneously moving the right split laminated media segment 134 toward print chopping station 102. This same action can occur in parallel or in series between the left split laminated media segment 136 and the rear platen left edge guide 100. At this point, either the right split media segment 134 or left split media segment 136 is ready to be chopped into full bleed durable prints 40.

The second mode case (i.e. FIG. 3B) in which a single edge trimmed laminated media segment is generated by the slitting station due to the large format image tiling requires a few modifications over the process just discussed. Basically two events must occur to handle the large format tiling arrangements. First, center slitter 108 needs to be disengaged. This is accomplished by disengaging the center slitter 108 using a center slitter retract mechanism 112. Second one of the edge slitters (left edge slitter 104 in the illustration provided by FIG. 3*a*) needs to be laterally positioned to accommodate the variable widths of the large format images. This is accomplished by using the edge slitter position mechanism 104, 106. Note that in the preferred embodiment, left edge slitter 104 is disengaged, laterally moved and then reengaged with no media transport occurring. A second method would be to move the edge slitter while transporting some laminate 86 through. This would eliminate the complex need to disengage and reengage, but would waste laminate material. In either scenario, the laminated media segment 62 is now trimmed into the edge trimmed laminated media segment 134. Note that all other alignment processing is the same as discussed except that only the right side of the rear platen 96 is utilized.

We have now reached the point where right split laminated media segment 134 and left split laminated media segment 136 (FIG. 3A) or the edge trimmed laminated media segment 138 (FIG. 3B) are ready to be print chopped. In this embodiment, FIG. 4 illustrates the use of single print chopper 122 such as a known guillotine or rotary chopper. This could as easily be shown as two print choppers, one for each split segment. However, this embodiment represents an attempt to keep cost down even though it is apparent that two print choppers would allow the overall throughput to be improved. While this statement is true from a single media segment 46 standpoint, the choice of one print chopper takes some other facts into account. Basically, the fact is that a factor in productivity is the amount of time for printer 18 to print a single media segment 46. Based on the state-of-the art, the speed required by post-print treatment processor 20 would be on the order of 1 inch per second. This speed is not significantly high. Therefore, this fact and the fact that a typical order requires three to nine media segments leads one to the conclusion that the print chopping operation will still have significant head room for speed in delivering full bleed durable prints.

Therefore, with single print chopper 122 the act of cutting right split laminated media segment 134 and left split laminated media segment 136 (FIG. 3A) or the single trimmed laminated media segment 138 (FIG. 3B) into full bleed durable prints 40 occurs as follows. Starting with right split laminated media segment 134 (the single trimmed laminated media segment could be substituted with no variation); urge rollers 72*a* feed it forward so that the lead edge enters the nip of lead edge metering rollers 124. Lead edge metering rollers 124 are already accelerated to a constant velocity and after they grab right split laminated media segment 134 it essentially has taken the transport control away from urge rollers 72*a*. Lead edge metering rollers 124 transports right split laminated media segment 134 forward until the media lead edge within the segment is detected by lead edge sensor 126. Since the location of the plurality of images 44 are known relative to this lead edge, lead edge metering rollers 124 begin to position right split laminated media segment 134 within print chopper 122. There are two basic cutting processes that can be used at this point. One process is to perform the entire cut in one cutting stroke. The second process is to perform the required cut by using a series of small cuts and metering jogs. The advantages of the two are system dependent but generally revolve around jamming issues. Using either method results in the waste media falling into waste drawer 120*b* below print chopper 122.

Once the waste media is trimmed off from the lead edge of the first image, lead edge metering rollers 124 transport right split laminated media segment 134 towards trail edge metering rollers 128. At this point, trail edge retract mechanism 132 has opened the nip of trail edge metering rollers 128. This is done in order that the lead edge of right split laminated media segment 134 can easily be pushed through this nip and positioned such that the trail edge of the image can be chopped. Once positioned, trail edge retract mechanism 132 closes and print chopper 122 is activated. This action now separates a finished print 40 from the rest of right split laminated media segment 134. Finished print 40 is now transported to one of entrance chutes 142 on sorting station 56. The same print chopping cycle is repeated for the plurality of images 44 on the rest of the right split laminated media segment 134. Once complete, the exact same process can be performed for the left split laminated media segment 136.

As noted trail edge metering rollers 128 act as the transport mechanism for moving full bleed durable prints 40 into sorting station 56. Sorting station 56 is the final process and is composed of a set of entrance chutes 142, an elevator mechanism 144, a set of exit trays 146 additional urge rollers (not shown). As noted before, sorting station 56 is functionally the mechanism that accepts full bleed durable prints 40 and stacks them in an appropriate manner which makes it easy for the photofinisher to get the full bleed durable prints 40 back to the customer. As with some of the other systems in this description, sorting station 56 in its own right is very complicated and is not the focus of this invention. However, the embodiment used in this invention simply allows elevator mechanism 144 to raise entrance chutes 142 such that a given finished print can be transported into one of the chutes. The finished print then slides down the chute due to gravity and is allowed to be transported to a selected exit tray 146 by means of urge rollers (not shown) associated with that exit tray. This process is controlled under the intelligence of control computer 58 and control electronics 60.

At this point the entire mechanical process of post-print treatment processor 20 has been described. As noted, post-print treatment processor 20 must have the intelligence and knowledge to run this process in a controlled manner. The intelligence is found in control computer 58 and control electronics 60 while the knowledge for operations comes from sensor feedback and data communications with the other major subsystems of photofinishing apparatus 10 and post-print treatment processor 20.

As noted, the invention provides for a transport system that can handle media segment 46 throughout various processes and which does not require a manual operation between the printer and the finisher.

Photofinishing apparatus 10 and method of the invention may be combined with known methods of borderless ink jet printing, such as those described in commonly assigned application Ser. No. 09/169,054 to Capurso, filed Oct. 9, 1998, now U.S. Pat. No. 6,168,259 and application Ser. No. 09/118,538 to Wen, filed Jul. 17, 1998, now U.S. Pat. No. 6,109,745.

Figure 6:
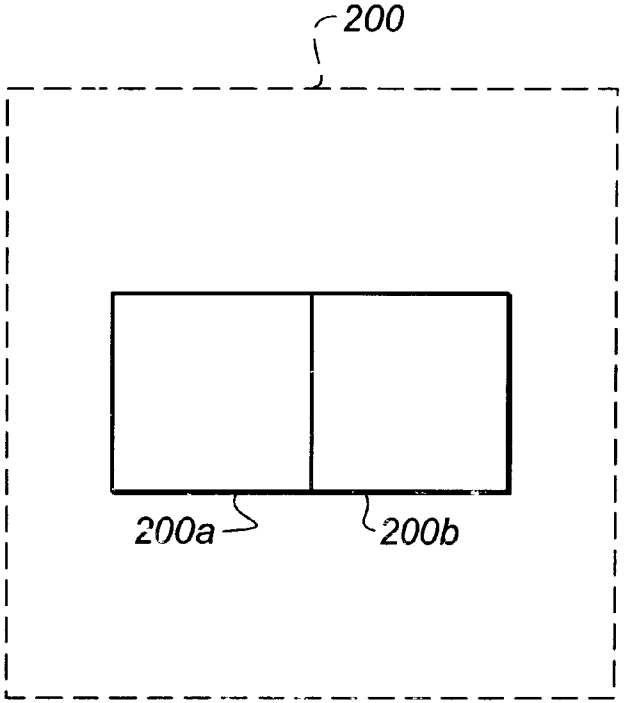
FIG. 6 illustrates a combined printing and finishing arrangement.

Further, the present invention is not limited to having printer 18 and finisher or post-print treatment processor 20 separately disposed as illustrated in FIG. 3. The printer and finisher could be in the form of a single unit 200 as shown in FIG. 6, which includes a printing station 200*a* that comprises at least printer 18 as described, and a finishing station 200*b* that comprises at least finisher 20 as described.

The invention has been described in detail with particular reference to certain preferred embodiments thereof, but it will be understood that variations and modifications can be effected within the spirit and scope of the invention.

What is claimed is:

1. A photofinishing apparatus comprising:

a) a film processor for processing rolls of film into negatives;

b) a scanner for digitizing the negatives or other printed images into raw image data;

c) an image data manager for processing the raw image data into processed image data;

d) a printer for converting the processed image data into printed images on a media segment; and e) a post-print treatment processor for converting the media segment into photographic quality durable full bleed prints, the post-print treatment processor including:

i. a dryer station for drying said media segment;

ii. a durability station for applying or fixing a durability material on said media segment;

iii. a cutting station for slitting and chopping said media segment into said photographic quality full bleed prints;

iv. a sorting station for sorting said photographic quality full bleed prints; and v. a control computer and control electronics for controlling the post-print treatment processor.

2. An apparatus according to claim 1, further comprising a transport mechanism for transporting said media segment through the post-print treatment processor.

3. An apparatus according to claim 1, wherein the dryer station further comprises drying and transporting components which include an entrance detection sensor, a front platen, urge rollers, a front platen edge guide and an exit detection sensor, said drying and transporting components permitting a drying of the media segment and a transport of the media segment to the durability station.

4. An apparatus according to claim 1, wherein the durability station comprises an application fixing mechanism, said application fixing mechanism being adapted to perform a durability application on the media segment and transport the media segment to the cutting station.

5. A photofinishing apparatus comprising:

a) a film processor for processing rolls of film into negatives;

b) a scanner for digitizing the negatives or other printed images into raw image data;

c) an image data manager for processing the raw image data into processed image data;

d) a printer for converting the processed image data into printed images on a media segment; and e) a post-print treatment processor for converting the media segment into photographic quality durable full bleed prints, the post-print treatment processor including:

i. a dryer station for drying said media segment;

ii. a durability station for applying or fixing a durability material on said media segment;

iii. a cutting station for slitting and chopping said media segment into said photographic quality full bleed prints;

iv. a sorting station for sorting said photographic quality full bleed prints; and v. a control computer and control electronics for controlling the post-print treatment processor;

wherein the cutting station comprises cutting and transporting elements which include a pull roller set, at least one segment detection sensor, a waste control mechanism, a rear platen, a rear platen right edge guide, a rear platen left edge guide, a chopping station, and a plurality of urge rollers, said cutting and transporting elements being adapted to convert the media segment into a multitude of said photographic quality durable full bleed prints, and transport said photographic quality durable full bleed prints to the sorting station.

6. A photofinishing apparatus comprising:

a) a film processor for processing rolls of film into negatives;

b) a scanner for digitizing the negatives or other printed images into raw image data;

c) an image data manager for processing the raw image data into processed image data;

d) a printer for converting the processed image data into printed images on a media segment; and e) a post-print treatment processor for converting the media segment into photographic quality durable full bleed prints, the post-print treatment processor including:

i. a dryer station for drying said media segment;

ii. a durability station for applying or fixing a durability material on said media segment;

iii. a cutting station for slitting and chopping said media segment into said photographic quality full bleed prints;

iv. a sorting station for sorting said photographic quality full bleed prints; and v. a control computer and control electronics for controlling the post-print treatment processor, wherein the sorting station comprises sorting elements which include an entrance chute, an elevator mechanism, and an exit tray, said sorting station being adapted to sort said photographic quality durable full bleed prints.

7. A post-print treatment processor for converting a media segment into photographic quality durable full bleed prints, the post-print treatment processor including:

i. a dryer station for drying said media segment;

ii. a durability station for applying or fixing a durability material on said media segment;

iii. a cutting station for slitting and chopping said media segment into said photographic quality full bleed prints;

iv. a sorting station for sorting said photographic quality full bleed prints; and v. a control computer and control electronics for controlling the post-print treatment processor.

8. A photofinishing apparatus comprising:

a printing station for printing a plurality of images on a media segment; and a finishing station for converting the media segment into durable fill-bleed prints;

the finishing station including:

a durability station for applying or fixing a durability material on said media segment; and a cutting station for slitting and chopping said media segment into said photographic quality full bleed prints.

9. A photofinishing apparatus according to claim 8, wherein said finishing station further includes a cutter for cutting said media segment having the durable material applied thereon into prints and a sorter for sorting the prints.

10. A photofinishing apparatus according to claim 8, wherein said images are tiled on said media segment.

11. A photofinishing apparatus according to claim 8, wherein said images are of various formats and are positioned on said media segment based on at least a geometry of the media segment.

12. A photofinishing apparatus according to claim 8, wherein said media segment includes borders between at least the images.

13. An imaging apparatus comprising:

a) a printer for producing a media segment having a plurality of printed images thereon;

b) a post-print treatment assembly provided in series with said printer and adapted to at least apply a durable material onto the media segment; and c) a controller adapted to control said printer and said post-print treatment assembly.

14. An imaging apparatus according to claim 13, wherein said post-print treatment assembly comprises a cutter for cutting said media segment having the durable material applied thereon into prints and a sorter for sorting the prints.

15. An imaging apparatus according to claim 13, wherein said images are tiled on said media segment.

16. An imaging apparatus according to claim 13, wherein said images are of various formats and are positioned on said media segment based on at least a geometry of the media segment.

17. An imaging apparatus according to claim 13, wherein said media segment includes borders between at least the images.

18. An imaging apparatus comprising:

a) a printer for producing printed images on a media segment; and b) a post-print treatment processor for converting the media segment into photographic quality durable full bleed prints, the post-print treatment processor including:

i. a dryer station for drying said media segment;

ii. a durability station for applying or fixing a durability material on said media segment;

iii. a cutting station for slitting and chopping said media segment into said photographic quality full bleed prints;

iv. a sorting station for sorting said photographic quality full bleed prints; and v. a control computer and control electronics for controlling the post-print treatment processor;

wherein the cutting station comprises cutting and transporting elements which are adapted to convert the media segment into a multitude of said photographic quality durable full bleed prints, and transport said photographic quality durable full bleed prints to the sorting station.

19. An imaging apparatus comprising:

a) a printer for producing printed images on a media segment; and b) a post-print treatment processor for converting the media segment into photographic quality durable full bleed prints, the post-print treatment processor including:

i. a dryer station for drying said media segment;

ii. a durability station for applying or fixing a durability material on said media segment;

iii. a cutting station for slitting and chopping said media segment into said photographic quality full bleed prints;

iv. a sorting station for sorting said photographic quality full bleed prints; and v. a control computer and control electronics for controlling the post-print treatment processor;

wherein the sorting station comprises sorting elements which include an entrance chute, an elevator mechanism, and an exit tray, said sorting station being adapted to sort said photographic quality durable full bleed prints.

20. A post-print treatment processor for converting a media segment into photographic quality durable full bleed prints, the post-print treatment processor including:

a dryer station for drying said media segment;

a durability station for applying or fixing a durability material on said media segment;

a cutting station for slitting and chopping said media segment into said photographic quality full bleed prints;

a sorting station for sorting said photographic quality full bleed prints; and a control computer and control electronics for controlling the post-print treatment processor;

wherein the cutting station comprises cutting and transporting elements which are adapted to convert the media segment into a multitude of said photographic quality durable full bleed prints, and transport said photographic quality full bleed prints to the sorting station.

21. A post-print treatment processor for converting a media segment into photographic quality durable full bleed prints, the post-print treatment processor including:

a dryer station for drying said media segment;

a durability station for applying or fixing a durability material on said media segment;

a cutting station for slitting and chopping said media segment into said photographic quality full bleed prints;

a sorting station for sorting said photographic quality full bleed prints; and a control computer and control electronics for controlling the post-print treatment processor, wherein the sorting station comprises sorting elements which include an entrance chute, an elevator mechanism, and an exit tray, said sorting station being adapted to sort said photographic quality full bleed prints.

* * * * *